United States Patent [19]

Zic

[11] Patent Number: 4,820,207

[45] Date of Patent: Apr. 11, 1989

[54] ELECTRICAL CONTACT

[75] Inventor: Richard Zic, Chicago, Ill.

[73] Assignee: Labinal Components and Systems, Inc., Elk Grove Village, Ill.

[21] Appl. No.: 787,136

[22] Filed: Aug. 19, 1987

Related U.S. Application Data

[63] Continuation of Ser. No. 815,479, Dec. 31, 1985, abandoned.

[51] Int. Cl.[4] ..... H01R 13/05

[52] U.S. Cl. ..... 439/825

[58] Field of Search ..... 439/816, 825, 826

[56] References Cited

U.S. PATENT DOCUMENTS

| | | | |
|---|---|---|---|
| 2,752,580 | 6/1956 | Shewmaker | 339/252 P |
| 3,693,140 | 9/1972 | Mijman | 339/252 P |
| 4,169,654 | 10/1979 | Plyler et al. | 339/252 P |
| 4,437,726 | 3/1984 | Lambert | 339/252 P |

FOREIGN PATENT DOCUMENTS

| | | | |
|---|---|---|---|
| 2514686 | 10/1975 | Fed. Rep. of Germany | 339/252 R |

*Primary Examiner*—Joseph H. McGlynn
*Attorney, Agent, or Firm*—Noel I. Smith; Joseph P. Calabrese

[57] ABSTRACT

A micro-miniature electrical contact comprises a first contact portion having spaced cantilever contact leaves with distal ends adapted to mutually engage, together with outwardly bowed control longitudinal portions. When received in a mating socket the leaves are resiliently urged inwardly to effect desired receptacle engagement and electrical connection.

In a preferred embodiment, the contact is formed by deep drawing a seamless, integral, generally cylindrical member in which a contact portion with leaves integrally joined at their distal ends is integrally formed with a receptacle portion adapted to engage an electrical conductor. Because of their construction, the provided contacts are adapted for repeated use without loss of resiliency.

14 Claims, 3 Drawing Sheets

FIG. 1
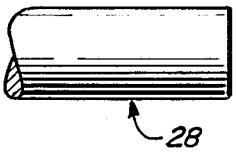
FIG. 2
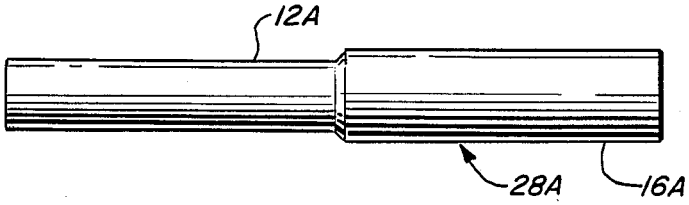
FIG. 3
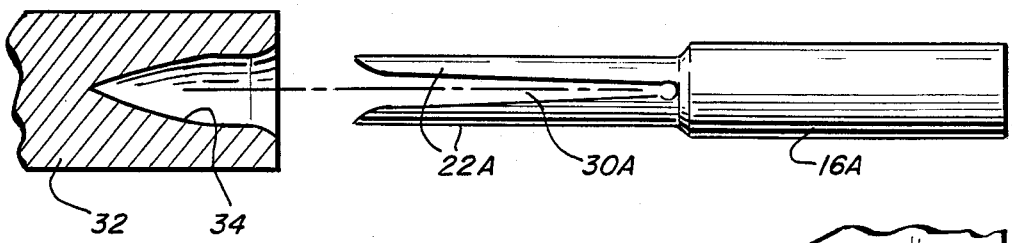
FIG. 3A
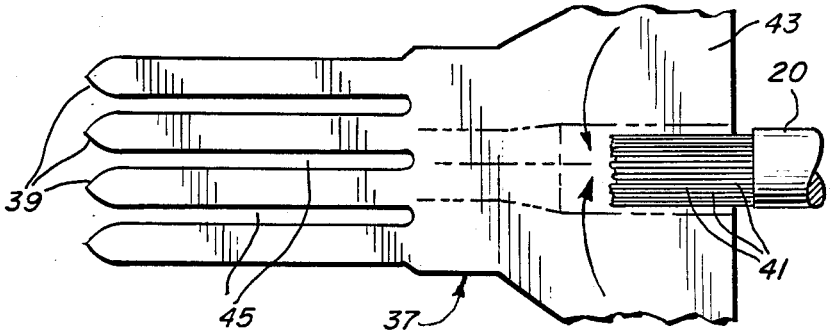
FIG. 4
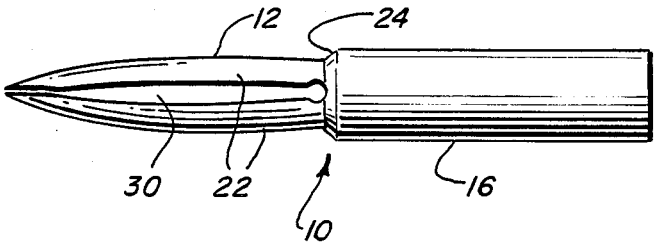
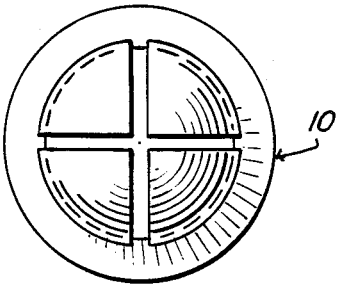
FIG. 5
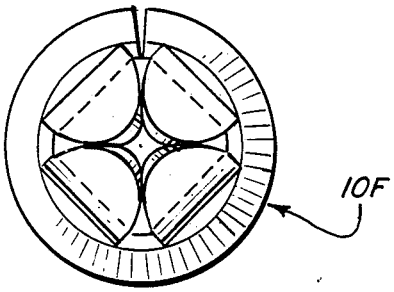
FIG. 5A

ELECTRICAL CONTACT

This is a continuation, of application Ser. No. 06/815/479, filed Dec. 31, 1985 now abandoned.

This invention relates to multi-leaf and to slotted electrical contacts, and more particularly pertains to low-insertion force contacts adapted for repeated use without loss of contact efficiency. This application is a continuation-in-part of my copending application Ser. No. 566,595 filed Dec. 29, 1983.

The development of computer technology has been accompanied by an attendant need for micro miniature contacts having low insertion forces for repeated connect-disconnect capabilities in receiving receptacles. Such contacts are employed in an ever-growing number of both civilian and military applications. Because of the tremendous numbers of such contacts which may be employed in a single installation, the need is also constantly growing for contacts which assure desired electrical communication while possessed of cycle durability and yet are of low cost.

In accordance with this invention novel low-insertion-force pin contacts are provided which possess all of the above noted desiderata. The contact constructions hereinafter described are particularly adapted for micro miniature size manufacture without any loss of contact efficiency or reliability after repeated insertion and withdrawal relative to contact sockets employed in completing an electrical connection.

One embodiment of the provided contact employs a multi-leaf contact portion integrally formed with a conductor receptacle or sleeve portion for securely engaging the end of an electrical conductor. The multi-leaf contact portion is adapted to inwardly resiliently flex in the course of insertion into the receptacle or socket of a mating connector element.

A preferred embodiment of the provided contact employs a slotted tubular barrel member having deformable, leaf-like contact portions integrally formed at their distal-tip portions. Such contacts also comprise integral, conductor-receiving barrel portions from which such joined contact portions extend. The joined leaf-like portions are able to resiliently flex, and due to their end connection are reinforced against twisting relative to each other in the course of insertion and withdrawal relative to a receiving socket.

The use of electrical contact having compliant insertable contact portions is well-known, as is the use of contacts requiring low insertion forces.

Thus, Griffin U.S. Pat. No. 4,166,667 discloses a circuit board connector system employing contacts having barrel portions of C-shaped cross-section which deform in the course of being received in electrically conductive openings of a circuit board.

Tamburro U.S. Pat. No. 4,076,356 discloses an interconnection pin for printed circuit boards having a compliant section of generally C-shaped sectional configuration with raised pressure ridges formed in the outer surface adapted to engage inner electrically conducting peripheries of circuit board openings in which received.

Schramm U.S. Pat. No. 4,191,440 discloses an electrical connector for compiling leads to circuit boards employing pin contacts having compliant sections of C-shaped cross-section and tapered ends for reception in plated openings of circuit boards.

Knowles U.S. Pat. No. 4,017,143 discloses a solderless electrical contact having a compressible, compliant barrel portion of C-shaped cross-section for reception in the plated openings of a circuit board.

Kurtz et al. U.S. Pat. No. 3,783,433 discloses contacts similar to those disclosed in the Knowles patent but which have compliant barrel portions of various sectional configuration, as well as detents for locking said contacts in fixed position relative to a receiving circuit board.

Gluntz U.S. Pat. No. 3,992,076 discloses a circuit board contact having cantilever spring arms which are insertable in the receiving openings of an insulating board. Solder is employed for effecting electrical contact between the contacts which are permanently set in place and a printed circuit on the surface of the board. The arms of the Gluntz contact are inadequate for providing the desired electrical contact and interlocking with the inner peripheries of the insulation board even were the latter peripheries coated with an electrical conducting material. There is no suggestion of contacts made in accordance with this invention in the Gluntz patent.

Nijman U.S. Pat. No. 3,693,140 is of interest in that it discloses miniature electrical contacts having projecting tines separated by wide slots, the tines being formed of similar gauge or different gauge material. The contact of this reference requires a plurality of machining operations not necessary in the formation of the contacts of this invention.

Plyler, U.S. Pat. No. 4,169,654 discloses a pin type electrical contact terminal formed of a slit sleeve. The open construction thereof does not provide the integrity present in the contacts hereinafter discussed.

Lambert U.S. Pat. No. 4,437,726 discloses a flexible pin construction composed of opposed formed fingers 15 and 16. Such pins similarly to the above noted Plyler pin construction do not possess the integrity of the structure of the contacts hereinafter described in detail.

German OS2514686 discloses a generally tubular pin contact requiring a large number of forming steps and of substantially semi-circular cross section along the major part of its length terminating at a sloping point for facilitating pin insertion. There is no suggestion of a cantilever leaf construction.

U.K. Pat. Nos. 241,785, 367,267 and 1,088,235 disclose various forms of contact plugs having bendable leaves. However, the constructions disclosed are either formed of a plurality of parts or of massive construction resulting in an expense of manufacture rendering the same unsuitable for applications satisfied by the contacts of this invention.

It is thus an object of this invention to provide an improved contact construction providing desired electrical contact with a mating socket and which provides redundant contact for desired electrical conductivity between the contact and socket defining an electrical connection.

It is a further object of this invention to provide a novel micro miniature electrical contact of excellent cycle durability which requires low insertion forces while at the same time assuring a desired, secure engagement with a receiving socket.

It is a further object of this invention to provide a novel one-piece unitary contact construction of micro miniature size employing resilient contact leaves integrally formed with and extending from a cylindrical barrel portion which securely engages an electrical conductor by means of a crimp engagement.

It is another object of this invention to provide a one piece unitary contact construction employing resilient contact leaves integrally formed with a cylindrical barrel portion at their proximal end portions. The provided contact leaves are also joined at their distal terminal ends by means of an interconnecting portion rendering the contact more unitary in nature whereby the leaves are resistant to twisting relative to each other. Such latter contacts may also be micro-miniature in size.

It is another object of this invention to provide a method for forming a novel contact construction by progressive drawing and slotting operations whereby contacts may be readily formed on a continuous basis from a thin sheet or strip of desired material of fabrication.

It is yet another object of this invention to provide a method for forming a novel contact made in accordance with this invention by simple extrusion and slotting steps which enable the contacts to be manufactured in a rapid manner although possessing a precise uniform construction maintained within desired dimensional tolerances.

It is yet another object of this invention to provide electrical contacts adapted for micro miniature use in which the contacts may be arranged in close-packed arrangement, as on centers of as little of 0.025 inch.

It is another object of this invention to provide a novel multi-leaf contact which is readily adaptable for incorporation with a contact portion having a compliant section, whereby the resulting contact may be received in adjacent receptacle portions such as openings in adjacent printed circuit boards adapted to be electrically connected.

The above and other objects of this invention will become more apparent from the following detailed description when read in the light of the accompanying drawing and appended claims.

In one embodiment of the provided invention an integral cylindrical contact body is formed by extrusion. One end of the cylindrical body has longitudinal slots formed therein so as to form spaced cantilever arms or leaves. An endwise force is applied to the distal ends of such leaves so as to urge such ends together while simultaneously uniformly, outwardly bowing each of the central portions of such leaves. Such outwardly bent portions form a maximum leaf periphery adapted for insertion in a cylindrical socket or receptacle which is electrically conductive or has an electrically conductive inner periphery so as to effect an electrical connection therewith. Such socket is of smaller diameter than the diameter of the maximum periphery defined by the contact leaves so as to insure an efficient multi-point contact.

The contact also employs a crimp barrel portion adapted to receive one end of an electrical conductor for secure engagement therewith.

In a modified extruded contact construction, the integral barrel portion of the contact opposed to the leaves may be connected as by welding or the like to an elongate slotted male contact portion having a compliant center section. The resulting contact may be received at opposed ends in female receptacle portions for purposes of effecting two electrical connections as will hereinafter be disclosed in greater detail.

In a further modified contact construction provided pursuant to this invention, an integral contact construction is formed by progressive deep drawing of a spinodal material or equivalent copper-based alloys having characteristics similar to those set forth in Unified Numbering System Standard No. 72900. The tubular formations drawn in such sheet material are slotted along opposed longitudinal edge portions so as to provide an integral, generally tubular body portion having spaced leaves separated by longitudinal slots. The leaves are joined at their proximal end portions with a cylindrical barrel portion adapted to receive a conductor. The leaves remain joined at their distal terminal ends following the slot formation, by means of an end connecting portion whereby a unitary contact construction results. The two leaves are bent outwardly by means of a force applied to the joined distal ends thereof so as to form a maximum leaf periphery insertable in a cylindrical, contact-receiving socket. The leaf maximum periphery is compliantly deformable in the course of engaging said socket assuring desired electrical contact.

The latter contact construction having leaf distal ends integrally formed, may also be integrally joined with an elongate barrel portion. The latter defines a second male portion with a second compliant center section in the manner above indicated for the first modified contact construction. The second compliant section may thus be received in a female receptacle for purposes of effecting a desired electrical connection.

For a more complete understanding of this invention reference will now be made to the drawings wherein:

FIG. 1 is a fragmentary elevational view of a slug of electrically conductive material which is adapted to be extruded into a contact made in accordance with this invention;

FIG. 2 is an elevational view illustrating the slug of FIG. 1 after the same has been subjected to an extrusion step;

FIG. 3 is an elevational view illustrating the extruded, generally cylindrical member of FIG. 2 after the narrower portion thereof has been slotted so as to form parallel slots therein, such slots defining the illustrated parallel contact leaves or arms;

Figure 6:
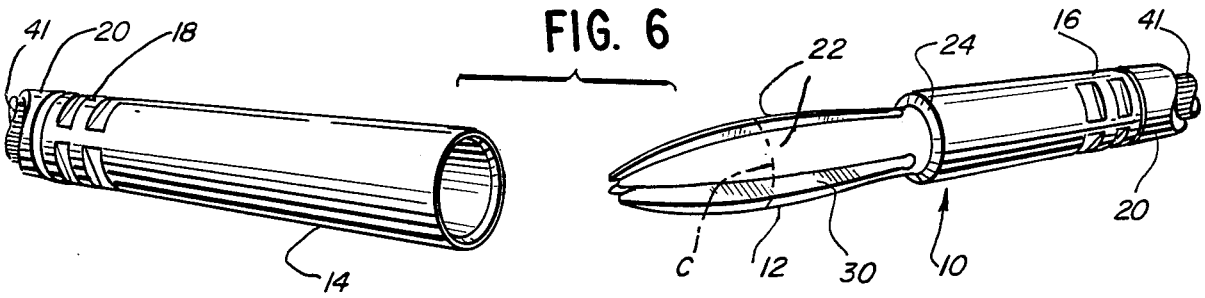
Figure 7:
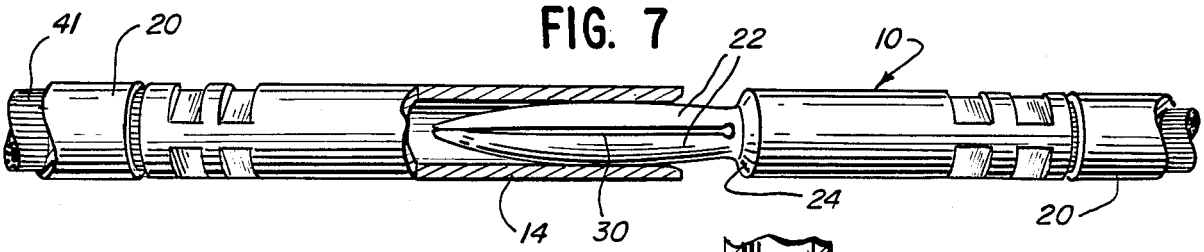
Figure 8:
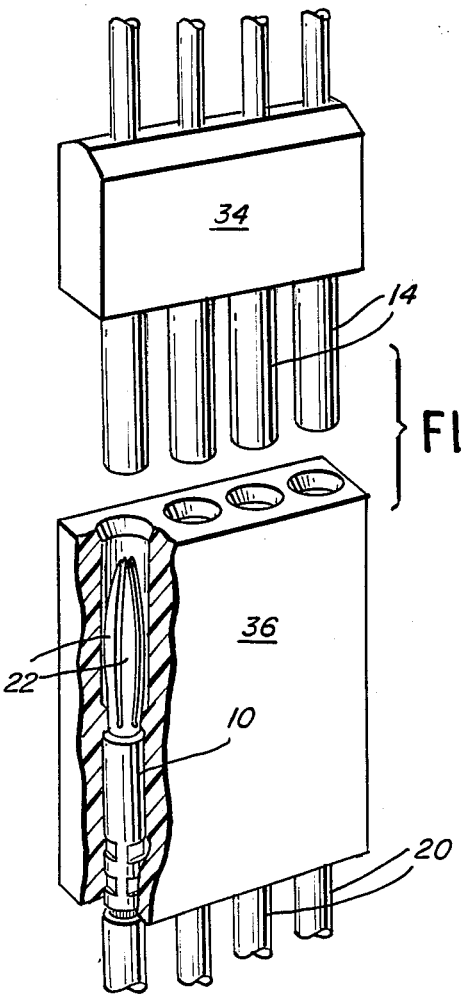
Figure 9:
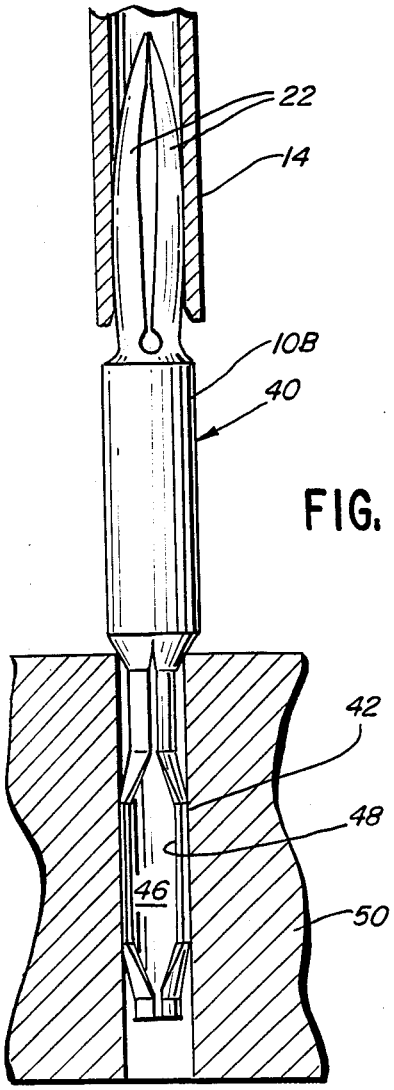
Figure 10:
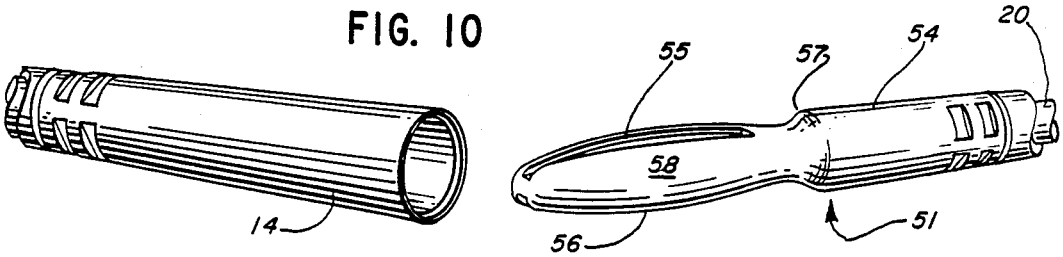
Figure 11:
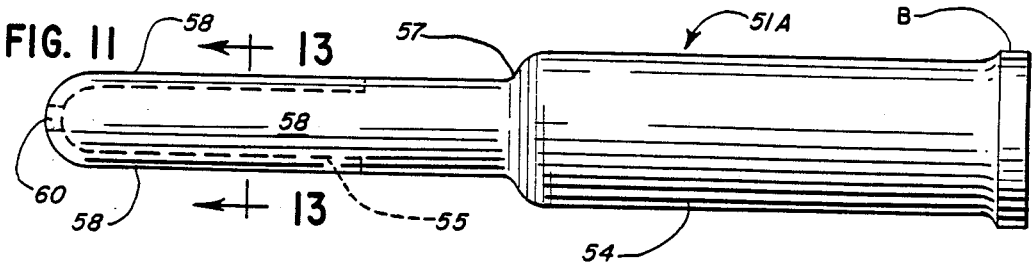
Figure 12:
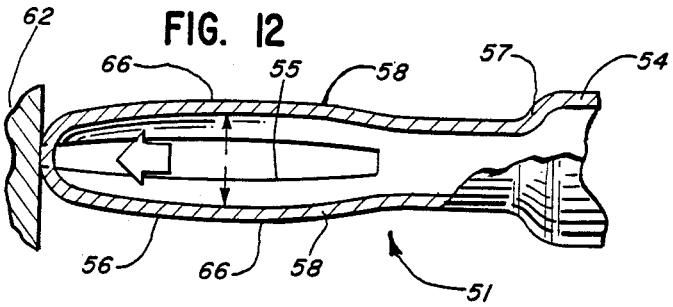
Figure 13:
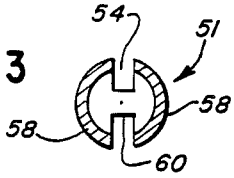
Figure 14:
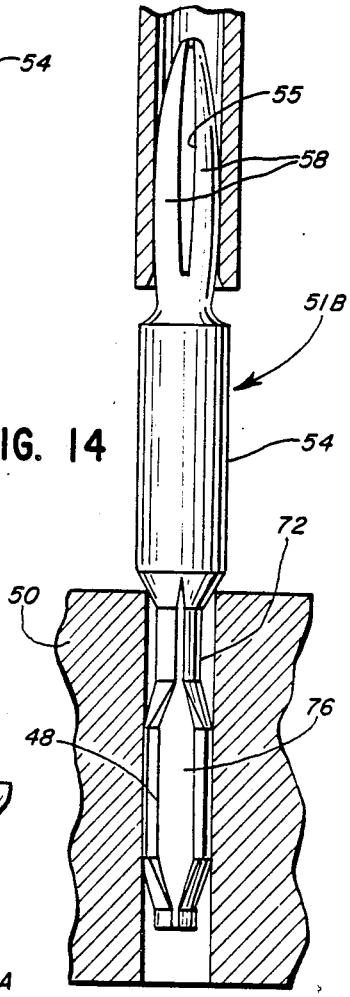
Figure 15:
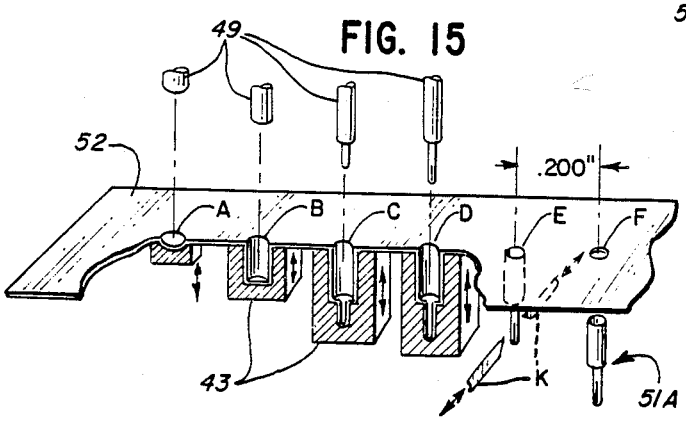

FIG. 3 also illustrates in section a die member adapted to engage the distal ends of the contact leaves;

FIG. 3A is a plan view of a slotted sheet fragment which may be employed for forming a contact made in accordance with this invention;

FIG. 4 illustrates in side elevation a contact made in accordance with this invention in which the parallel contact leaves of FIG. 3 following die engagement have the distal ends thereof urged into adjacent relationship and, are bowed outwardly; the outward bows formed in each of the leaves defining points on a maximum leaf circumference;

FIG. 5 is an end view of the contact leaves of FIG. 4;

FIG. 5A is an end view illustrating a modified contact which has flat contact leaves;

FIG. 6 is a perspective view illustrating one embodiment of a contact made in accordance with this invention in crimped engagement with an electrical conductor and in spaced relation with a female socket also illustrated in crimped engagement with an electrical conductor;

FIG. 7 is an elevational view, partly broken away, illustrating the contact and socket of FIG. 6 in mated engagement for purposes of effecting a desired electrical connection;

FIG. 8 is a perspective view partly broken away, illustrating a plurality of the contacts and sockets of FIGS. 6 and 7 mounted in connector housings;

FIG. 9 is an elevational view partly in section illustrating a modified contact construction made in accordance with the teachings of this invention;

FIG. 10 is a perspective view similar to FIG. 6 illustrating a modified contact construction in which the opposed leaf portions thereof are integrally formed at their terminal ends;

FIG. 11 is a side elevational view of the contact illustrated in FIG. 10 in an initial stage of formation and illustrated on a scale enlarged thereover;

FIG. 12 is a fragmentary sectional view partly broken away, of the contact illustrated in FIG. 11 in the process of striking a strike plate for purposes of forming a blow in the opposed leaf portions thereof so as to form the contact configuration of FIG. 10;

FIG. 13 is a transverse sectional view taken on line 13—13 of FIG. 11;

FIG. 14 is a view similar to FIG. 9 illustrating a further modified contact construction made in accordance with the teaching of this invention in engagement with a PC board, and FIG. 15 is a fragmentary perspective view illustrating the process sequence whereby the contacts illustrated in FIGS. 10 through 14 may be formed as a result of a series of metal drawing steps. FIG. 15 is schematic in nature and not drawn to scale.

Referring more particularly to FIG. 6 a contact 10 made in accordance with this invention is illustrated. having a multi-leaf contact portion 12 adapted to be received in a female socket or receptacle 14. It will be noted from FIG. 6 that both the contact 10 and the socket 14 have integral barrel portions 16 and 18 respectively which are crimped to electrical conductors 41 extending through illustrated tubular insulating members 20. There may, of course, be applications in which the provided contacts 10 and/or sockets 14 are employed in which the conductors are in an environment not requiring outer insulation, in which event the coverings 20 may be eliminated.

The leaved portion 12 of each contact 10 comprises a plurality of leaves or blades 22 which, are cantilever spring arms extending from adjacent an inner contact annulus 24. Annulus 24 interconnects the barrel or conductor receiving receptacle portion 6 and the contact portion 12.

In accordance with one embodiment of this invention, each contact 10 comprises an integral seamless element which is extruded from a slug of an electrically conducting material, such as slug 28 illustrated in FIG. 1. As a result of an extrusion step, extrusion 28A of FIG. 2 is formed having concentric and integrally formed tubular portions 16A and 12A from which the contact portions 16 and 12 of FIG. 6 are formed.

Although the portions 16A and 12A are of different diameter as illustrated to accommodate a conductor for conductors of precise size at its barrel portion and to form spaced contacts 22 of desired peripheral arrangement at opposed end 12, a barrel of uniform diameter may be extruded from which contact portions 12 and 16 may be formed. Contact 10 is then formed by slotting the barrel portion 12*a* of the extruded element 28*a* of FIG. 2, resulting in the parallel leaves 22A of FIG. 3 separated by four slots 30A, one of which is illustrated in side elevation.

It will be noted from FIGS. 4 and 6 of the drawing that slots 30 which are formed in he completed contact 10 may vary in width with a resulting variance in the width of each of the leaves 22. Thus it will be noted that each slot 30 begins inwardly of each contact portion 12, extending from a curved periphery, widens in the course of progressing along the length of the contact barrel portion in which formed, whereafter the slot narrows upon approaching the distal end of the barrel portion 12. Each leaf 22 is thus seen to widen as it proceeds outwardly toward the distal contact end after which it will again taper upon approaching such distal end.

Following slotting of the extrusion 28*a* of FIG. 2 resulting in the configuration of FIG. 3, die 32 having surface 34 and the distal ends of the spaced leaves 22A of FIG. 3 are moved into engagement. Following die engagement the slotted extrusion will become the completed contact 10 of FIG. 4 in which the distal ends of the four leaves are brought into mutual contact or closely spaced relationship (see FIG. 5). Simultaneously with the converging of the leaves by the die 32, the central portion of each leaf 22 will be bowed outwardly to form a maximum leaf circumference as represented by dotted line C of FIG. 6, which will effect contact with the inner periphery of a receiving socket or receptacle such as the socket 14 of the drawing.

FIG. 7 of the drawing illustrates the contact leaves 22 and socket 14 of FIG. 6 in the normal mated condition. A comparison of the positions of the leaves 22 in FIGS. 6 and 7 demonstrates the manner in which such leaves are inwardly resiliently flexed in the course of effecting contact with the inner periphery of the socket 14. It is apparent from FIG. 7 that each leaf 22 of contact portion 12 comprises in effect a cantilever spring arm touching at its outermost end with the adjacent leaves 22 at least during socket engagement, and extending at its inner end from adjacent annulus or periphery 24 with which each leaf is integrally formed. The leaves are thus seen to engage in a complementary, self-reinforcing engagement at their distal ends when in mating engagement with a socket.

Each contact 10 is preferably formed of an extrudable, electrically conducting material such as a berylium copper alloy or a copper nickel tin alloy. Such alloys and alloys such as spinodal alloys are known in the art and provide desired electrical conductivity in addition to providing desired resiliency in each of the leaves or cantilever spring arms 22 of each contact 10. Because each leaf 22 is supported or in biasing engagement at opposed ends in the mated condition with the receiving socket as illustrated in FIG. 7, each leaf 22 is provided with a desired resistance to inward flexing as each leaf is formed to flex inwardly from its maximum periphery C illustrated in FIG. 6. FIG. 5 illustrates the adjacent relationship of distal ends of the leaves 22 in the normal position of rest as well as their complementary structural relationship. In accordance with this invention the leaf ends may be in mutual contact or slightly spaced apart in a position of rest. The normal gap between spaced leaf tips is of the order of a few thousandths of an inch.

FIG. 7 illustrates the connection of a single contact and a mating socket. It is, of course, apparent to those skilled in the art that a plurality of such contacts and sockets may be mounted in electrically insulating housings for purposes of forming a multi-conductor connector. In FIG. 8 a plurality of electrical connections is simultaneously effected by mating housing 34 in which the female sockets 14 are mounted in aligned relationship with housing 36 in which the contacts 10 are correspondingly aligned. Latching members not illustrated but well-known in the art may be employed in conjunction with the housings 34 and 36 so that upon engagement of the lower surface of housing 34 and upper surface of housing 36, not only are the contacts in desired electrical engagement with their associated mating sockets in the manner illustrated in FIG. 7 but, in addition, the housing members 34 and 36 are latched together.

It will be appreciated by those skilled in the art that the arrangement of FIG. 8 is illustrative of one manner only of employing contacts made in accordance with this invention. The provided contacts may also be employed for purposes of effecting electrical communication as with a circuit on a PC board. The contact structure above described lends itself to ready incorporation in micro miniature applications, that is, for packaging in installations in which the contacts are packaged with in-line centers having as little as 0.1 inch spacing and diagonally arranged centers of about 0.005 inch spacing.

It will be further appreciated that the contact embodiment 10 illustrated in the drawing utilizing four substantially parallel leaves 22 is provided by way of illustration only. A minimum of three discrete leaves are normally employed for purposes of assuring a stable interconnection with a receiving socket.

However, by appropriate slot formation and size relationship between the contact and receptacle diameters stable surface-to-surface contact between each leaf and the receptacle results if a two-leaved contact is employed. In the contact embodiments of FIGS. 1 through 9, each leaf 22 provides a separate point of contact with the electrically conductive surface of its mating socket. Accordingly, the greater the number of leaves 22, the greater the number of electrical contacts. The provision of eight separate leaf members would provide eight separate points of contact; the possible number of leaves formed is dictated in part by the size of the original barrel which is slotted for leaf formation.

It will be appreciated that the contacts of this application comprises most satisfactory substitutes for the more complex twist pin connectors of the type disclosed in Phillips U.S. Pat. Nos. 3,255,430 and 3,319,217. Methods of forming such pins are disclosed in Phillips Pat. No. 3,402,466. It will be noted that in forming these twist pins a plurality of wires are employed for conforming compliant male pin portions including seven outer wires wound about an inner core which may comprise one or more core wires. A typical twist pin construction is composed of eleven discrete elements. The plurality of elements and method of manufacturing such twist pins entail an expense which is approximately five times that of manufacturing the contact pins of this invention.

It is apparent from the foregoing description that the provided contact 10 of FIGS. 4 and 6, by employing a unitary extruded construction, has eliminated any seams which may comprise points of weakness in a formed contact. Such seams may separate after a crimping operation in which a barrel portion of the contact is crimped to an electrical conductor. By the utilization of the continuous barrel with integral cantilever leaf contact elements, a contact construction is provided possessed of excellent cycle durability.

The basic structure provided readily lends itself to custom manufacture. Thus a number of leaves may be formed to provide the desired number of contacts with the female receptacle; it is contemplated that normally the number of leaves in the contacts of FIGS. 4 through 9 would comprise any number between 4 and 8, although 2 are also workable.

The basic leaf construction provided in the above-described contact may be incorporated in a contact formed from rolled sheet material such as sheet segment 37 of FIG. 3A which has been predeterminately stamped or otherwise appropriately formed so as to form spring arms 39 separated by slots 41. Following rolling of the segment 37 into a cylindrical form the unslotted sheet portion may be crimped to conductors 41 extending from tubular insulator 20. The sheet portion may first be rolled into a cylindrical form prior to slotting. Such a rolled sheet will, of course, not have the unitary construction above described and would obviously be susceptible to separation along the seam. However, it is apparent that in certain applications crimping a contact to a conductor or conductor may serve to securely lock the contact to the encompassed conductor so that the danger of seam separation is extremely small or nonexistent when a multi-stranded conductor is crimped. However, when a solid conductor is employed, separation along the contact seam normally occurs with resulting poor electrical conductor-contact conductivity. Also, a separate manufacturing step may be employed to secure the seam-defining portions of the contact together. Contacts formed from such sheet construction would work to equal advantage with the contacts 10 illustrated in the drawing, and, the resulting contacts would look similar to contacts 10 but have a longitudinal seam.

A modified contact construction 40 is illustrated in FIG. 9 wherein an upper contact portion 10B substantially identical to the contact 10 above described is formed integrally as by welding or the like at W, with a contact portion 42 having a compliant barrel portion 46. The barrel portion 46 has an elongate slot 48 which tapers at opposed longitudinal ends. In the normal course of utilization of the contact of FIG. 9, the contact portion 10B may be received in a socket in the manner above described, whereas the compliant barrel portion 46 may also be received in a female receptacle for purposes of effecting an electrical connection. Thus the contact illustrated in FIG. 9 has opposed male portions each of which is adapted to be received in a female receptacle. The contacts of FIG. 9 may serve many applications as, for instance, the connection of circuits on PC boards, barrel portion 46 illustrated in FIG. 9 being received in a plated through opening of a PC board 50.

Another feature of the provided contacts which enables the same to be customized for particular uses comprises the ability to control the length of the slots 30 formed in an extruded cylindrical element or in a rolled sheet element for purposes of forming the spaced parallel leaves or spring arms 22. It is apparent that the longer the slots 30 the longer each cantilever spring leaf, and as a result such longer leaf is more susceptible to flexing upon receipt in a receiving socket. Accordingly, by shortening the length of the slots formed in a contact, the more resistant to bending the resulting leaves become. Thus, by regulating the lengths of the slots 30 a ready means is available for controlling the insertion forces necessary for effecting an interconnection with a mating receptacle element. The slots 30 need not extend the length of the contact portion 12 as in the illustrated contact embodiment 10.

A further modification of the provided contacts 10 comprises the flattening of one or more of the leaves 22 after formation. Such leaf flattening will result in contact being effected by each leaf along opposed longitudinal edges upon insertion in a cylindrical socket. FIG. 5A illustrates such a flat-leaved contact 10F.

By way of example only, a contact above described and made in accordance with this invention may have the following dimensions. The contact, such as contact 10 illustrated in the drawing, may be formed from a copper-nickel-tin alloy and be approximately 0.005 inch in thickness. The contact may be approximately ¼ inch in length with the leaf contact portion 12 and the barrel portion 16 each constituting approximately one-half of the overall length. The diameter of the maximum periphery formed in the bowed central portions of the leaves of such contact would be approximately 0.028 inch, and the diameter of the barrel portion 16 of such contact would be approximately 0.0375 inch. The terminal ends of the leaves of such a contact are in adjacent relationship at rest, i.e., either touching or have a gap therebetween of approximately 0.005 inch. The foregoing dimensions may, of course, be modified while still etaining the various inventive features above described in detail.

FIG. 10 is a view similar to FIG. 6 and illustrates a preferred contact construction 51 which is formed as a result of a series of progressive deep drawing operations schematically illustrated in FIG. 15. In the course of such drawing operations a sheet of material 52 formed of a copper-nickel-tin spinodal alloy well known in the art is subjected to a progressive series of drawing steps in which punches 49 deform the sheet 52 by forcing the same into underlying apertured dies 43. The provided sheet 52 may be of a thickness of the order of 0.004 inch and be in the form of an intermittently moving strip which successively engages each of a series of five drawing punches prior to entering a shearing station whereat a completely drawn contact body 51 A is sheared or punched free from the mother sheet 52, as seen in FIG. 15. The four punches 49 operable in forming the underlying metal deformations are of decreasing width and increasing length as the metal deformation progresses and sheet 52 is moved in the direction of the arrow as illustrated in FIG. 15. The punches 49 and/or sheet 52 are appropriately lubricated as by spraying with a lubricating oil during the drawing operations in a manner well known in the art.

At Station A of FIG. 15 a slight depression or dimple is made in the sheet 52 of spinodal alloy by a reciprocating punch 49. At station B a further indentation is made by a punch and the metal is further drawn downwardly to form a cup-like depression. In station C a still closed longer tubular depression is formed as a third punch 49 draws the metal yet further downwardly. In station D the drawing is completed. In station E the finally drawn closed tube is engaged by opposed knife members K which skive material from oppositely disposed peripheral portions of the deformed metal, forming opposed slots 55 therein equivalent slotting apparatus known in the art may be employed for slot formation. Slots 55 are more clearly seen in FIG. 11. In station F illustrated in FIG. 15, the contact 51A is sheared free from its connection to the mother sheet 52. The slots may be formed following shearing of the drawn tubular construction from the sheet.

The drawn contact 51A will initially have an outer configuration as illustrated in FIG. 11. Contact barrel portion 54 is adapted to receive a conductor or conductors such as conductor 20 of FIG. 10 in the manner of contact 10 of FIG. 6. The initial contact form 51A further comprises an integrally formed, leaved portion 56 comprising joined, opposed leaves 58, see FIG. 11 which are spaced apart by slots 55.

It will be noted from FIGS. 10 and 12 that each final contact form 51 contains leaves 58 having outwardly bowed portions intermediate its opposed ends. The leaf proximal end portions are integrally formed and joined with the contact barrel portion 54 annulus 57, and the terminal end potions of the opposed leaves 58 extending from annulus 57 of each contact 51 are jointed by an interconnecting portion 60 most clearly seen in FIG. 13. The contact blank or form 51A subsequent to being sheared or punched from the sheet 52 is urged against a strike plate such as plate 62 fragmentarily illustrated in FIG. 12 for purposes of having the bowed portions of maximum diameter 66 formed therein. The bowed portions 66 will then resiliently conform when inserted in the opening of a receiving receptacle such as socket 14 illustrated in FIG. 10. A strike plate such as plate 62 may be movable relative to the finally formed contact while still formed with sheet 52 of FIG. 15.

The leaf-bearing steps schematically illustrated in FIG. 12 resulting in the bowed leaves in the contacts 51 also result in slots 55 with widths which conform with the degree of bowing in the sleaves defining the slots. Accordingly, the leaves of contacts 51 upon resilient flexing when engaging receiving receptacles may flex to the maximum degree where the slots are of maximum width.

It is apparent from the foregoing description of contact 51 that the same comprises two opposed leaves 58 which are joined at their terminal ends by means of interconnecting contact portion 60 with which integrally formed. As a result, the leaves 58 are restrained from twisting relative to each other even when subjected to high insertion forces where received in a receptacle, and maintain a rigid unitary state in the normal course of use.

By way of example only, the contacts 51 of FIGS. 10 through 15 may have the following dimensions. The two main segments of each contact 51, one segment comprising the leaved portion 56 and the second segment comprising barrel portion 54 may each be approximately 0.125 inch in length. Barrel portion 54 may have an average thickness of between 0.005 and 0.006 inch. The average outer diameter of the barrel portion 54 may be approximately 0.035 inch plus or minus 0.002 inch. Base end portion B of contact 51 (see FIG. 11 may have a maximum diameter of approximately 0.04 inch and defines a reinforced funnel opening for reception of one or more conductors. The outer diameter of the smaller tubular portion 56 illustrated in FIG. 11 of the contact form 51A may be approximately 0.021 inch.

Following engagement with a strike plate in the manner illustrated in FIG. 12, the leaved portions 58 of the contact 50 will have a nominal diameter 66 of approximately 0.0265 inch. The width of the leaf interconnecting portions 60 illustrated in FIG. 13 may be approximately 0.005 to 0.008 inch.

It is contemplated that microminiature contacts of this invention be received in receptacles having a diameter approximately 0.044 inch smaller in diameter. Thus contacts 51 of the aforenoted dimensions be received in sockets having a diameter of approximately 0.022 inch.

The basic contact structure 51 illustrated in FIGS. 10 through 12 may be readily formed into a contact construction 51B such as illustrated in FIG. 9 wherein the barrel portion 54 of contact 51B of FIG. 14 which is integrally formed with a contact portion 72 having a compliant barrel portion 76. The barrel portion 76 has an elongate slot 58 which it tapers at opposed longitudinal ends. In the normal course of utilization of the contact of FIG. 14, contact portion 56 may be received in a socket in the manner above described, whereas the compliant barrel portion 76 may be received in a receptacle for purposes of effecting an electrical connection. As a result, the provided contact construction of FIG. 14 may serve many applications as for instance the interconnection of circuits or elements on separate PC boards. Barrel portion 76 illustrated in FIG. 14 is illustrated in electrical communication with a plated through opening in the PC board 50. The slotted barrel portion 76 of contact 51B illustrated in FIG. 14 may have all the functions and advantages of the comparable barrel portion 46 of the contact 40 illustrated in FIG. 9 and may be similarly modified so as to provide customized engagement. It should be noted that the extruded contacts 10 above described have a length to width ratio of less than 5. Accordingly, the contact 4 of FIG. 9 must be formed of two separate pieces joined at W by welding or the like. By employing the deep drawing process above described in forming contacts 51, and 51B of FIG. 14, such contacts may be formed from a single integral cup or close-ended tubular member without the necessity of joining a plurality of contact elements as by welding or the like. Contacts formed in accordance with the deep drawing steps above disclosed may have a length to width ratio of as large as 10-1. The drawn two-leaved contact 51 is provided by way of example only and contacts with three and more leaves are also contemplated as within the scope of this invention. Both contacts 51 and 10 may be of substantially uniform diameter along their lengths.

Also, the deep drawing formation techniques allow the formation of even smaller contact sizes. Thus, drawn contacts may be mounted on in-line centers which are spaced apart as little as 0.05 inch and may be mounted on diagonally aligned centers which are spaced apart 0.025 inch.

The process steps of extrusion and deep drawing above described may result in working hardening of the metal of the contacts formed. Appropriate heat treatments known in the art may be employed to provide the contacts with the desired ductility and resilience necessary for being secured to an electrical conductor and for engaging a mating receptacle.

It is thus seen that a micro miniature contact has been provided particularly adapted for use in those installations where extremely large numbers of contacts are required and miniature size is a necessity. Exemplary uses are in computer installations for both civilian and military use. The provided contacts of the various embodiments illustrated in the drawings of this case may be readily made and provide repeated connect and disconnect operation without loss of resiliency. The provided contacts are less expensive to manufacture than the twisted wire and machined contacts of the prior art which had heretofore been employed in micro miniature applications such as those served by the contacts of this application. The provided contacts are inexpensive to manufacture and may be manufactured with a minimum number of processing steps. The processing steps are both technically simple and economical to carry out.

It is believed that the foregoing description has made apparent a number of modifications which may be made in the invention disclosed without departing from the ambit thereof. Accordingly this invention is to be limited only by the scope of the appended claims.

What is claimed is:

1. A low insertion force, microminiature contact resulting from the die formation of a resilient, electrically conductive material of fabrication; said contact having a first generally tubular portion formed by said die formation comprising at least two cantilever spring leaves having proximal ends extending from an inner annulus comprising a continuous periphery and terminal distal ends; a second tubular portion extending from said annulus in a direction opposite to said leaves; said first and second tubular portions and the interconnecting annulus being integrally formed in the course of said die formation of said resilient material of fabrication; said leaves being in substantially parallel, spaced relationship relative to the contact longitudinal axis; central portions of said leaves between said proximal and distal ends being bowed outwardly relative to said longitudinal axis so as to define portions of a maximum circumference defined by said leaves and the said terminal distal ends being fused for restricting the independent longitudinal movement of any one of said leaves relative to the other whereby insertion of said first contact portion in a mating socket having a receiving opening smaller than said maximum circumference results in substantially uniform resilient flexing of the leaf portions to assure electrical contact to said leaves with the inner periphery of said socket.

2. The contact of claim 1 in which said contact comprises a seamless, integral, extruded member formed of an extrudable copper-based alloy and said leaves are separate resilient cantilever elements.

3. The contact of claim 1 in which said cantilever leaves are substantially flat.

4. The contact of claim 1 in which each leaf is of such cross-section as to effect engagement along opposed longitudinal edges when received in a cylindrical socket of such size as to receive said first tubular contact portion and force said leaves together.

5. The contact of claim 1 in which said contact second portion is integrally joined with a third contact portion having a slotted, compliant barrel portion adapted to reduce in cross-section in the course of being received in the opening of a receiving socket having a cross-section smaller than that defined by said compliant barrel portion.

6. The contact of claim 5 in which said third contact portion is of substantially C-shaped cross-sectional configuration and has a longitudinal slot which is of greater width intermediate the ends of said third contact portion whereby said intermediate slotted portion of said third contact portion may resiliently deform when received in such receiving socket opening; said third contact portion having a cross-section which is smaller than the cross-section of said contact second tubular portion.

7. A low insertion force, microminiature contact formed by the deep drawing of resilient, electrically conductive material such as spinodal alloy or the like and having a first generally tubular portion comprising at least four spaced cantilever spring leaves having proximal ends extending from an inner annulus comprising a continuous periphery and terminal distal ends; a second tubular portion for receiving a conductor and connected to said first tubular portion by said annulus; said first and second tubular portions and the interconnecting annulus being drawn as an integral member from said resilient material; said cantilever spring leaves being separated by slots in substantially uniform, spaced relationship relative to the contact longitudinal axis; central portions of said leaves between said proximal and distal ends being bowed outwardly relative to said longitudinal axis so as to define contact portions or maximum circumference defined by said leaves and separated by portions of said slots of maximum width and said terminal distal ends being fused for restricting the independent longitudinal movement of any one of said cantilever spring leaves relative to the other whereby insertion of said first contact portion in a mating socket having a receiving opening smaller than said maximum circumference results in substantially uniform resilient flexing of the cantilever spring leaf portions to assure electrical contact of said leaves with the inner periphery of said socket.

8. The electrical contact of claim 1 or 7 in which said contact is approximately one-quarter inch in length, and is formed of an electrically conductive material of approximately 0.005 inch in thickness.

9. The low-insertion force contact of claim 7 in which said contact tubular segments have a nominal diameter of about 0.026 inch, and said tubular segments are received in receptacle openings having diameters of approximately 0.0222 inch.

10. In combination, a plurality of micro-miniature contacts of claim 7 arranged on centers of approximately 0.05 inch in a receiving receptacles.

11. The contact of claim 1 or 7 in which said first and said second tubular portions are of different average diameters.

12. The contact of claim 7 in which the unslotted length of the contact tube comprises a conductor receptacle adapted to be compressed into secure electrical engagement with a conductor receivable therein.

13. A method of forming microminiature contacts comprising the steps of progressively deep drawing a portion of a sheet of electrically conductive material into a close-ended tubular configuration extending from said sheet; forming spaced slots in peripheral wall portions of the drawn tubular configuration so as to form at least two cantilever spring leaves, fusing said cantilever spring said leaves at their distal ends by a contact terminal portion preventing longitudinal movement between said leaves; outwardly bowing said leaf segments intermediate the leaf ends, and separating the formed tubular contact from the remainder of the sheet of conductive material from which formed.

14. The method of claim 13 in which the tubular configuration is drawn so as to have a length-to-width ratio of greater than 5 to 1.

* * * * *

UNITED STATES PATENT AND TRADEMARK OFFICE

CERTIFICATE OF CORRECTION

PATENT NO. : 4,820,207

DATED : April 11, 1989

INVENTOR(S) : Richard Zic

It is certified that error appears in the above-identified patent and that said Letters Patent is hereby corrected as shown below:

Col. 9, line 22, "etaining" should be --retaining--.

Col. 11, line 22, "4" should be --40--.

Col. 13, line 9, "or" should be --of--.

Col. 14, line 20, "said" should be deleted.

Signed and Sealed this

Third Day of December, 1991

*Attest:*

HARRY F. MANBECK, JR.

*Attesting Officer*

*Commissioner of Patents and Trademarks*